US011371746B2

(12) United States Patent
Sugai et al.

(10) Patent No.: US 11,371,746 B2
(45) Date of Patent: Jun. 28, 2022

(54) INDOOR UNIT OF AIR-CONDITIONING APPARATUS

(71) Applicant: Mitsubishi Electric Corporation, Tokyo (JP)

(72) Inventors: Shota Sugai, Tokyo (JP); Yasushi Oba, Tokyo (JP); Kunio Matsushita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 366 days.

(21) Appl. No.: 16/476,682

(22) PCT Filed: Mar. 15, 2017

(86) PCT No.: PCT/JP2017/010377
§ 371 (c)(1),
(2) Date: Jul. 9, 2019

(87) PCT Pub. No.: WO2018/167868
PCT Pub. Date: Sep. 20, 2018

(65) Prior Publication Data

US 2019/0390872 A1 Dec. 26, 2019

(51) Int. Cl.
*F24F 13/20* (2006.01)
*F24F 1/0057* (2019.01)

(52) U.S. Cl.
CPC ..... *F24F 13/20* (2013.01); *F24F 1/0057* (2019.02); *F24F 2221/26* (2013.01)

(58) Field of Classification Search
CPC ..... F24F 13/20; F24F 1/0057; F24F 2221/26
USPC ..... 454/233
See application file for complete search history.

(56) References Cited

FOREIGN PATENT DOCUMENTS

| | | | |
|---|---|---|---|
| JP | S60-125431 | U | 8/1985 |
| JP | H03-056819 | B2 | 8/1991 |
| JP | H05-026101 | B2 | 4/1993 |
| JP | 2001-041561 | A | 2/2001 |
| JP | 2008-121968 | A | 5/2008 |
| JP | 2008-215687 | A | 9/2008 |
| JP | 2009-085485 | A | 4/2009 |

OTHER PUBLICATIONS

International Search Report of the International Searching Authority dated Jun. 13, 2017 for the corresponding International application No. PCT/JP2017/010377 (and English translation).

*Primary Examiner* — Avinash A Savani
*Assistant Examiner* — Ryan L Faulkner
(74) *Attorney, Agent, or Firm* — Posz Law Group, PLC

(57) ABSTRACT

An indoor unit of an air-conditioning apparatus includes a front design panel in which a recess is formed as a suction port through which air is sucked, the recess being depressed rearward from a front face and extending in a width direction. The front design panel includes a lower panel extending in the width direction below the recess, an upper panel extending in the width direction above the recess, and a connecting portion connecting a back side of the lower panel and a back side of the upper panel. The connecting portion includes a bottom wall extending rearward from the lower panel, and an inner wall extending upward from the bottom wall and connecting to the upper panel. The bottom wall is located below an upper edge of the lower panel.

3 Claims, 16 Drawing Sheets

INDOOR UNIT OF AIR-CONDITIONING APPARATUS

CROSS REFERENCE TO RELATED APPLICATION

This application is a U.S. national stage application of PCT/JP2017/010377 filed on Mar. 15, 2017, the contents of which are incorporated herein by reference.

TECHNICAL FIELD

The present invention relates to an indoor unit of an air-conditioning apparatus, a suction port of which is formed in a front design panel.

BACKGROUND ART

Conventionally, as an indoor unit of an air-conditioning apparatus, an indoor unit having a front design panel with a flat surface geometry has been known. Since the front design panel is flat, the indoor unit is of a design that blends in with an interior. Here, an upper suction port is formed in upper part of the indoor unit and the indoor unit takes in indoor air through the upper suction port. A heat exchanger is provided inside the indoor unit and the heat exchanger is shaped to extend in an up/down direction. Here, when one attempts to take in indoor air only through the upper suction port of the indoor unit, at first the indoor air flows into upper part of the heat exchanger, but subsequently it becomes hard for the indoor air to flow into lower part of the heat exchanger sufficiently. This results in a shortage of indoor air flowing into lower part of the heat exchanger. Thus, an indoor unit is proposed in which suction port is provided in a front design panel, extending in a width direction. With this indoor unit, heat exchange performance of the heat exchanger is improved because the indoor air taken in through the suction port in the front design panel flows also into lower part of the heat exchanger. Also, since the suction port is formed in the front design panel, extending in the width direction, an accent is given to the design of the indoor unit.

However, since the suction port is formed in the front design panel, extending in the width direction, the front design panel is divided into upper part and lower part, which might reduce strength of the front design panel. Patent Literature 1 discloses an indoor unit having a front design panel in which a suction port is formed in the shape of a recess, dividing the front design panel into upper part and lower part. The upper part and lower part of the front design panel of Patent Literature 1 are connected with each other by a reinforcement unit. The technique of Patent Literature 1 intends to curb reduction in the strength of the front design panel by connecting the upper part and lower part of the front design panel with each other using the reinforcement unit. Note that lower part of the reinforcement unit extends horizontally rearward from an upper end of the lower part of the front design panel.

CITATION LIST

Patent Literature

Patent Literature 1: Japanese Unexamined Patent Application Publication No. 2008-121968

SUMMARY OF INVENTION

Technical Problem

However, in the indoor unit disclosed in Patent Literature 1, since the lower part of the reinforcement unit extends horizontally rearward from the upper end of the lower part of the front design panel, light reflected off the lower part of the reinforcement unit is reflected onto an inner wall, i.e., a wall on the far side of the reinforcement unit. Consequently, part provided with the reinforcement unit brightens. On the other hand, that part of the suction port that is not provided with the reinforcement unit remains dark because light enters inner part of the indoor unit without being reflected. In this way, in the suction port of the front design panel, light and dark fringes appear, spoiling the design of the indoor unit.

The present invention has been made to overcome the above problem and provides an indoor unit of an air-conditioning apparatus without spoiling the design of the indoor unit.

Solution to Problem

An indoor unit of an air-conditioning apparatus according to an embodiment of the present invention comprises a front design panel in which a recess is formed as a suction port through which air is sucked, the recess being depressed rearward from a front face and extending in a width direction, wherein: the front design panel includes: a lower panel extending in the width direction below the recess, an upper panel extending in the width direction above the recess, and a connecting portion connecting a back side of the lower panel and a back side of the upper panel, the connecting portion includes: a bottom wall extending rearward from the lower panel, and an inner wall extending upward from the bottom wall and connecting to the upper panel, and the bottom wall is located below an upper edge of the lower panel.

Advantageous Effects of Invention

In the embodiment of the present invention, since the bottom wall of the connecting portion is located below the upper edge of the lower panel of the front design panel, when light is reflected off the bottom wall, the reflected light is reflected onto a low position of the inner wall. This makes it possible to inhibit part on which the connecting portion is provided from brightening. In this way, light and dark fringes are less liable to appear in the suction port of the front design panel, and thus the design of the indoor unit is not spoiled.

DESCRIPTION OF EMBODIMENTS

Embodiment 1

Figure 1:
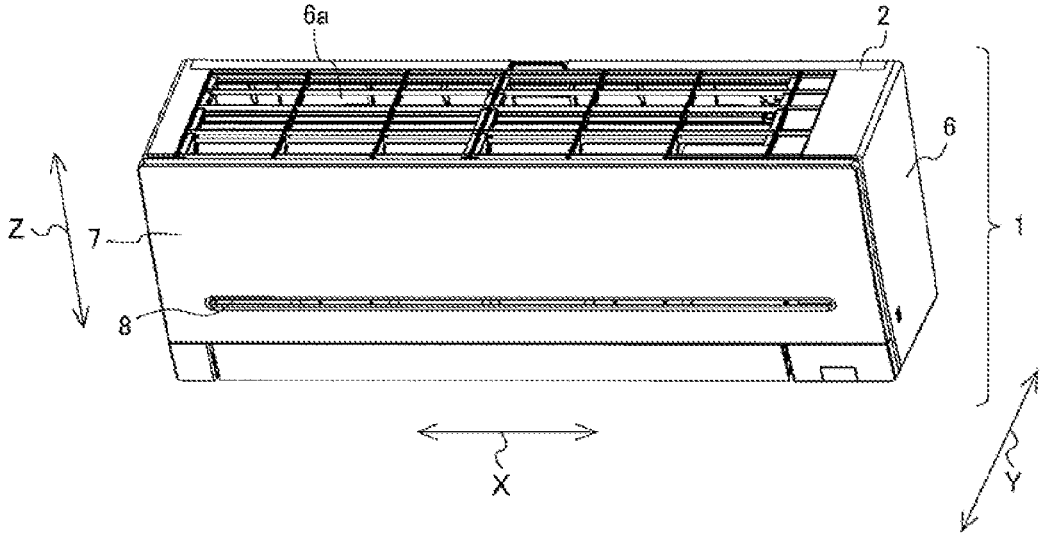
FIG. 1 is a perspective view showing an indoor unit 1 of an air-conditioning apparatus according to Embodiment 1 of the present invention.
Figure 2:
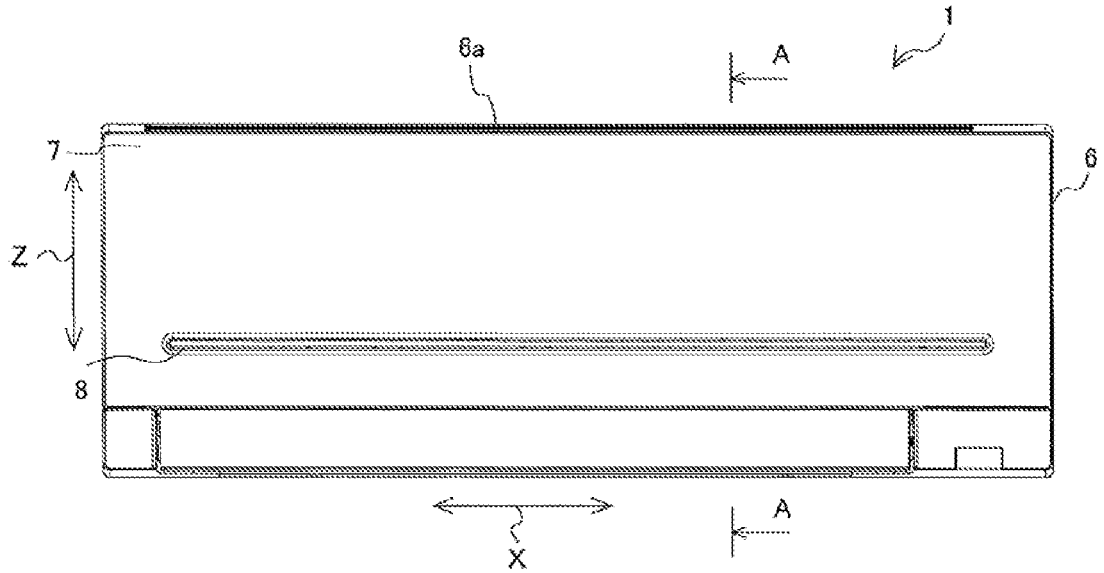
FIG. 2 is a front view showing the indoor unit 1 of the air-conditioning apparatus according to Embodiment 1 of the present invention.

Embodiments of an indoor unit of an air-conditioning apparatus according to the present invention will be described below with reference to the drawings. FIG. 1 is a perspective view showing an indoor unit 1 of an air-conditioning apparatus according to Embodiment 1 of the present invention, and FIG. 2 is a front view showing the indoor unit 1 of the air-conditioning apparatus according to Embodiment 1 of the present invention. Based on FIGS. 1 and 2, the indoor unit 1 of the air-conditioning apparatus will be described. As shown in FIGS. 1 and 2, the indoor unit 1 of the air-conditioning apparatus includes a rear case 2, a side design panel 6, and a front design panel 7.

The rear case 2 is a flat-plate member attached to a wall or other structure in a room making up a space to be air-conditioned by the air-conditioning apparatus. The side design panel 6 is a box-shaped object attached to edges of the rear case 2, extending forward from the rear case 2. An upper suction port 6*a* through which air is sucked is formed in that part of the side design panel 6 that makes up the top of the indoor unit 1. The front design panel 7 is a flat-plate member making up a front face of the indoor unit 1 and covering a heat exchanger 3 and other components housed inside.

A suction port 8 through which air is sucked is formed in the front design panel 7. Consequently, an amount of sucked indoor air is increased, improving heat exchange performance of the heat exchanger 3 and an accent is given to the design of the indoor unit 1. Note that the front design panel 7 is rotatably mounted on shafts provided on opposite sides in upper part of the side design panel 6, and consequently configured to be attached/detached and closed/opened freely relative to the side design panel 6. By opening the front design panel 7, installation, cleaning, inspection, and other operations can be carried out easily.

Figure 3:
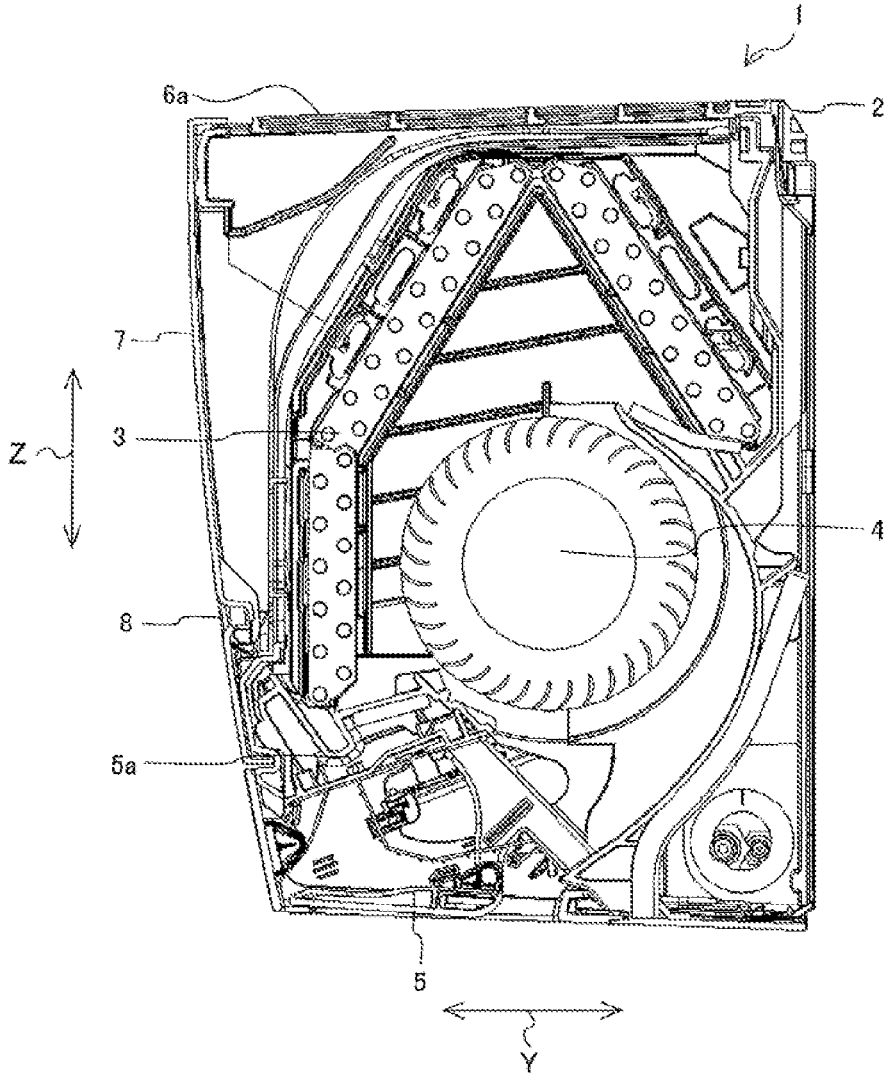
FIG. 3 is a sectional side view showing the indoor unit 1 of the air-conditioning apparatus according to Embodiment 1 of the present invention.

FIG. 3, which is a sectional view taken along line A-A in FIG. 2, is a sectional side view showing the indoor unit 1 of the air-conditioning apparatus according to Embodiment 1 of the present invention. As shown in FIG. 3, the indoor unit 1 contains the heat exchanger 3, a blower fan 4, a drain pan 5*a*, and an electrical component box (not shown). The heat exchanger 3 is a device adapted to exchange heat between indoor air and refrigerant. The blower fan 4 is a device adapted to send air sucked through the upper suction port 6*a* and suction port 8 to the heat exchanger 3. The drain pan 5*a* is a device adapted to catch dew condensation water attaching to the heat exchanger 3.

An air outlet 5 adapted to blow out the air heat-exchanged by the heat exchanger 3 into the room is formed below the drain pan 5*a*. The electrical component box contains control equipment adapted to control the blower fan 4 and other devices. The air sucked by the blower fan 4 through the upper suction port 6*a* and suction port 8 is heated or cooled by being heat-exchanged with refrigerant by the heat exchanger 3 and blown out into the room through the air outlet 5. Consequently, the room is heated or cooled.

Figure 4:
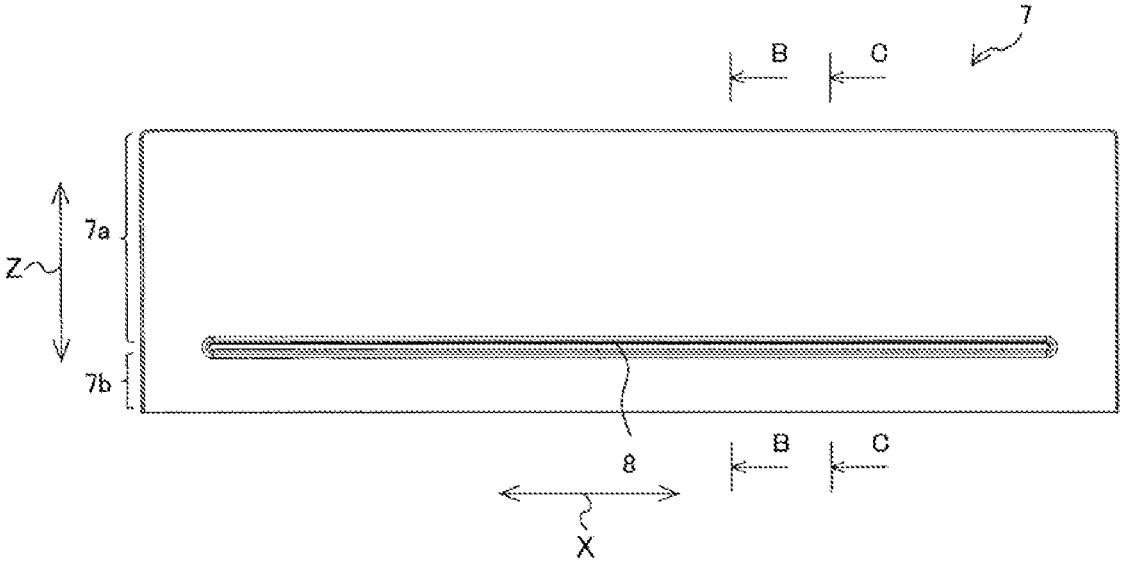
FIG. 4 is a front view showing a front design panel 7 according to Embodiment 1 of the present invention.

FIG. 4 is a front view showing the front design panel 7 according to Embodiment 1 of the present invention. As shown in FIG. 4, in the front design panel 7, a recess is formed in the front design panel 7 as the suction port 8 through which air is sucked, the recess being depressed rearward from a front face and extending in a width direction. Of the front design panel 7, part extending in the width direction below the recess is referred to as a lower panel 7*b* and part extending in the width direction above the recess is referred to as an upper panel 7*a*. Note that the lower panel 7*b* and upper panel 7*a* are connected with each on opposite sides of the front design panel 7. In this way, the lower panel 7*b* and upper panel 7*a* are structured integrally.

Figure 5:
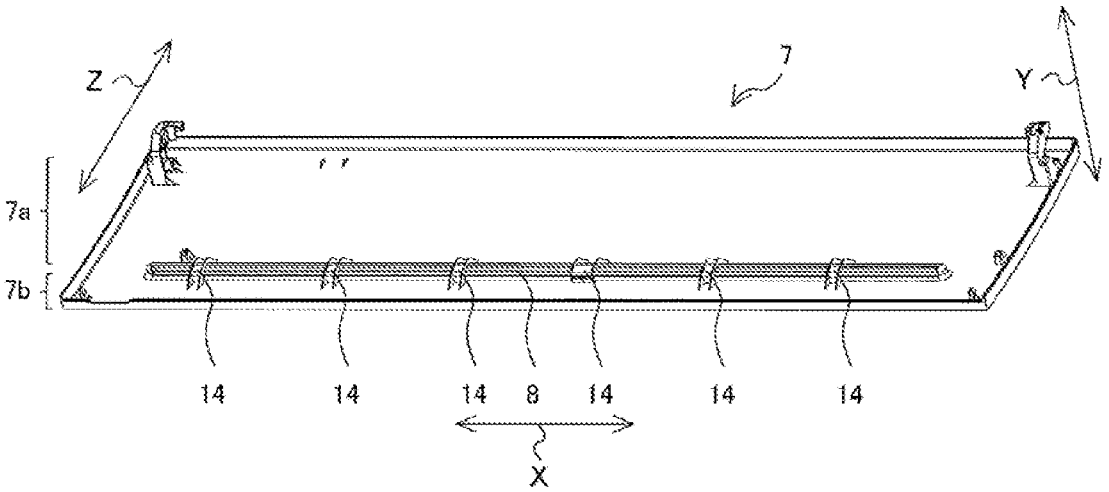
FIG. 5 is a rear perspective view showing the front design panel 7 according to Embodiment 1 of the present invention.

FIG. 5 is a rear perspective view showing the front design panel 7 according to Embodiment 1 of the present invention. As shown in FIG. 5, the upper panel 7*a* and lower panel 7*b* are not only connected with each other on opposite sides of the front design panel 7 but also connected in central part of the front design panel 7 by plural connecting portions 14. In this way, since the lower panel 7*b* and upper panel 7*a* of the front design panel 7 are connected with each other on their back sides by the connecting portions 14, reduction in the strength of the front design panel 7 can be curbed. Note that the connecting portions 14 are formed integrally with the upper panel 7*a* and lower panel 7*b*.

Figure 6:
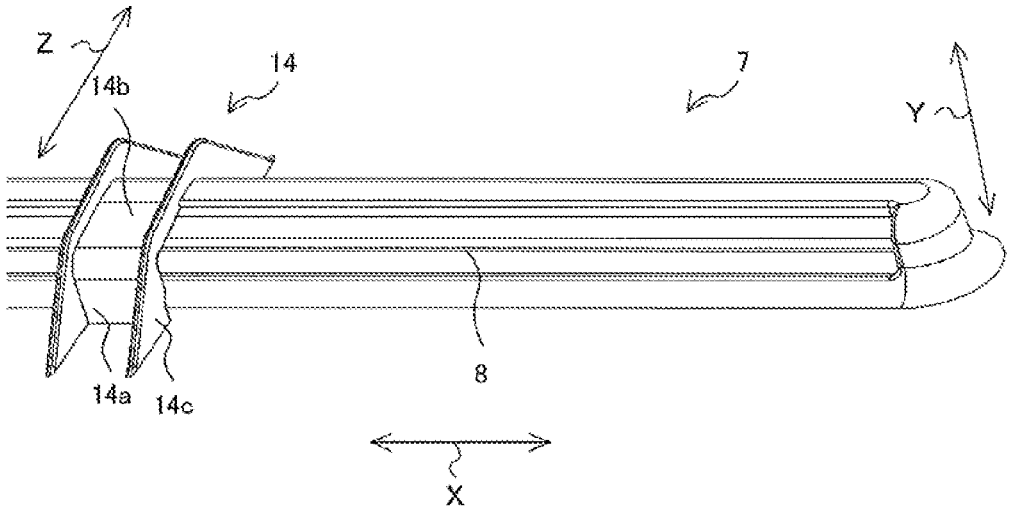
FIG. 6 is a rear perspective view showing a connecting portion 14 of the front design panel 7 according to Embodiment 1 of the present invention.

FIG. 6 is a rear perspective view showing the connecting portion 14 of the front design panel 7 according to Embodiment 1 of the present invention. As shown in FIG. 6, the connecting portion 14 includes a bottom wall 14*a*, an inner wall 14*b*, and bridging portions 14*c*. The bridging portions 14*c* are parts provided at opposite ends of the bottom wall 14*a* and inner wall 14*b*, extending behind the bottom wall 14*a* and inner wall 14*b*, to connect the lower panel 7*b* and upper panel 7*a* with each other.

Figure 7:
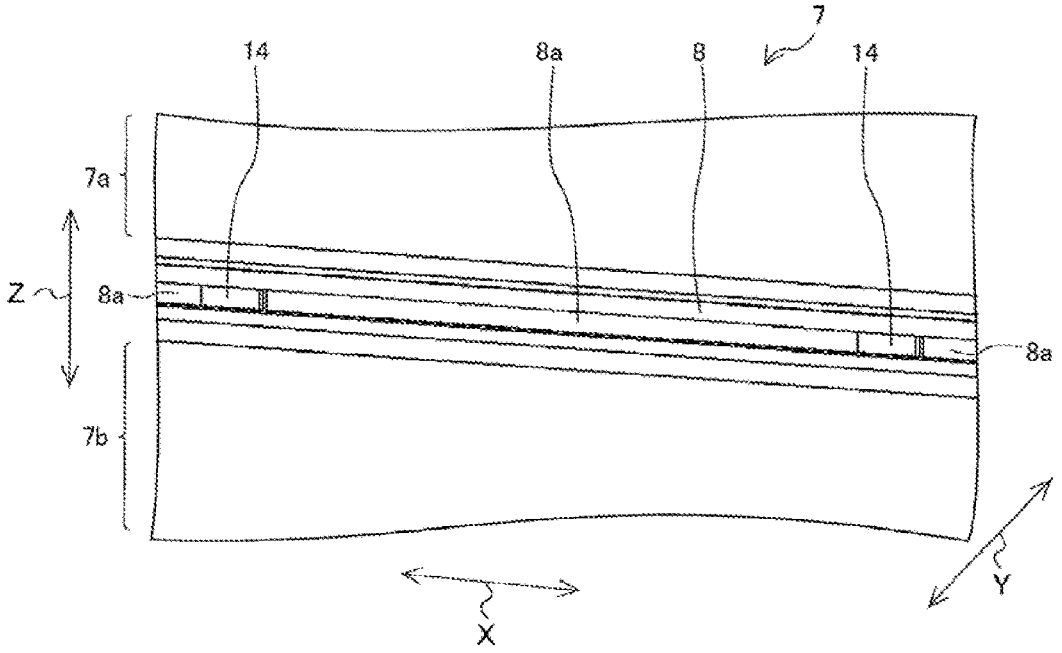
FIG. 7 is a front perspective view showing the connecting portions 14 of the front design panel 7 according to Embodiment 1 of the present invention.

FIG. 7 is a front perspective view showing the connecting portions 14 of the front design panel 7 according to Embodiment 1 of the present invention. As shown in FIG. 7, the connecting portions 14 are provided on part of the suction port 8 in the front design panel 7. Those parts of the suction port 8 on which no connecting portion 14 is provided are suction slits 8*a* adapted to actually suck in air.

Figure 8:
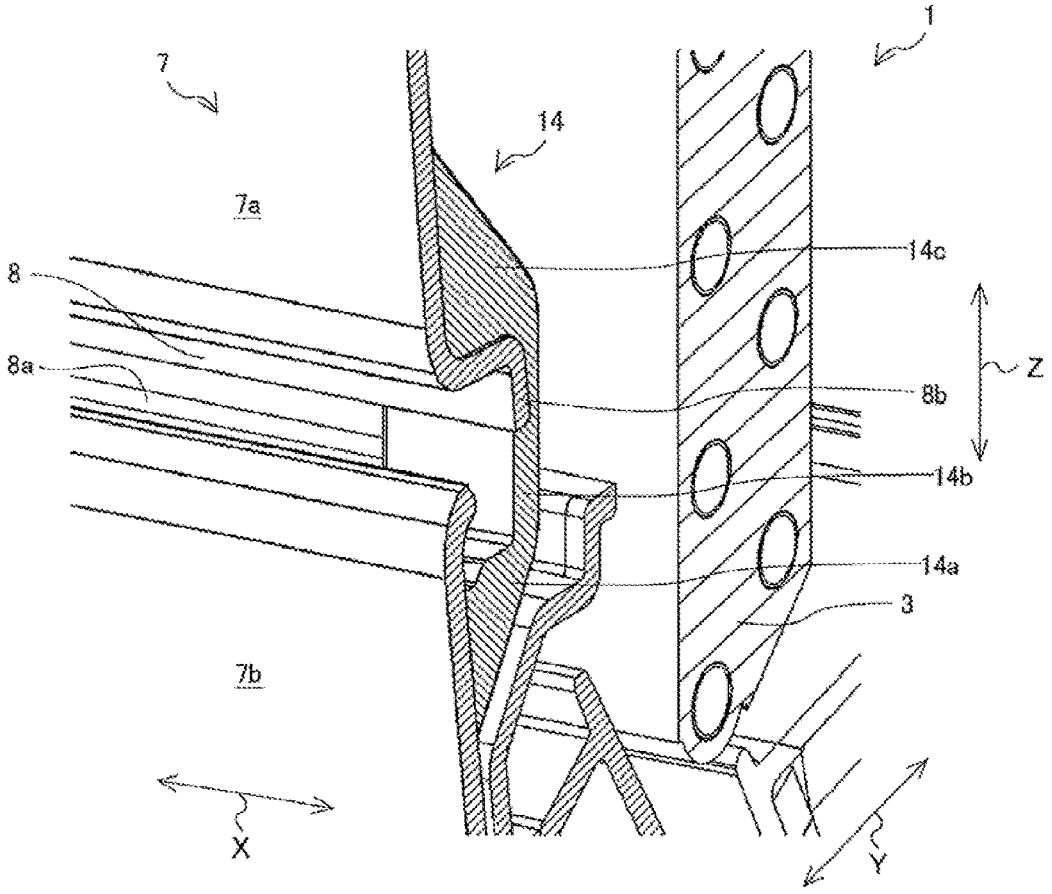
FIG. 8 is a perspective side view showing the indoor unit 1 of the air-conditioning apparatus according to Embodiment 1 of the present invention.

FIG. 8, which is a sectional view taken along line A-A in FIG. 2, is a perspective side view showing the indoor unit 1 of the air-conditioning apparatus according to Embodiment 1 of the present invention. As shown in FIG. 8, an upper edge of the lower panel 7*b* is bent slightly rearward. A lower end of the upper panel 7*a* is bent slightly rearward, and then downward to be an upper inner wall 8*b*. Consequently, internal parts of the heat exchanger 3 and other devices inside the indoor unit 1 are not visible to people located in the room. As described above, each of the connecting portions 14 includes the bottom wall 14*a* and inner wall 14*b*. The bottom wall 14*a* is a part extending rearward from a position below the upper edge of the lower panel 7*b*. The inner wall 14*b* is a part extending upward from a rear end of the bottom wall 14*a* and connecting to the upper inner wall 8*b* of the upper panel 7*a*. Here, the bottom wall 14*a* is located below the upper edge of the lower panel 7*b*.

Figure 9:
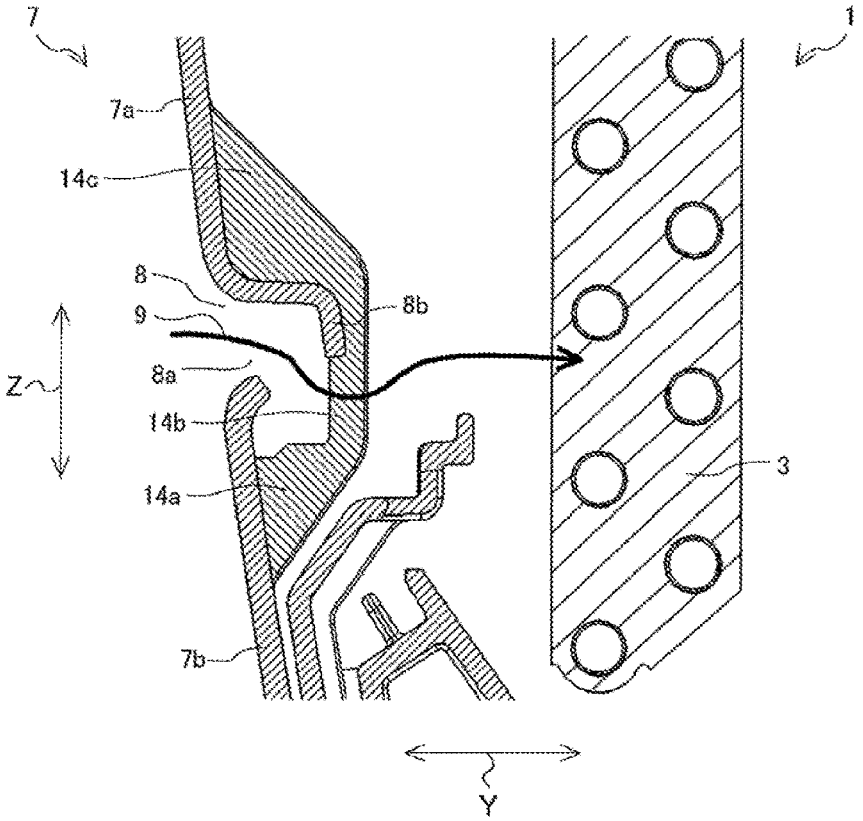
FIG. 9 is a sectional side view showing the indoor unit 1 of the air-conditioning apparatus according to Embodiment 1 of the present invention.

FIG. 9, which is a sectional view taken along line A-A in FIG. 2, is a sectional side view showing the indoor unit 1 of the air-conditioning apparatus according to Embodiment 1 of the present invention. Next, a flow of air 9 sucked through the suction port 8 will be described. As shown in FIG. 9, the air 9 sucked through the suction port 8 passes through the suction slits 8*a*, i.e., those parts of the suction port 8 on which no connecting portion 14 is provided, and reaches the heat exchanger 3.

Figure 10:
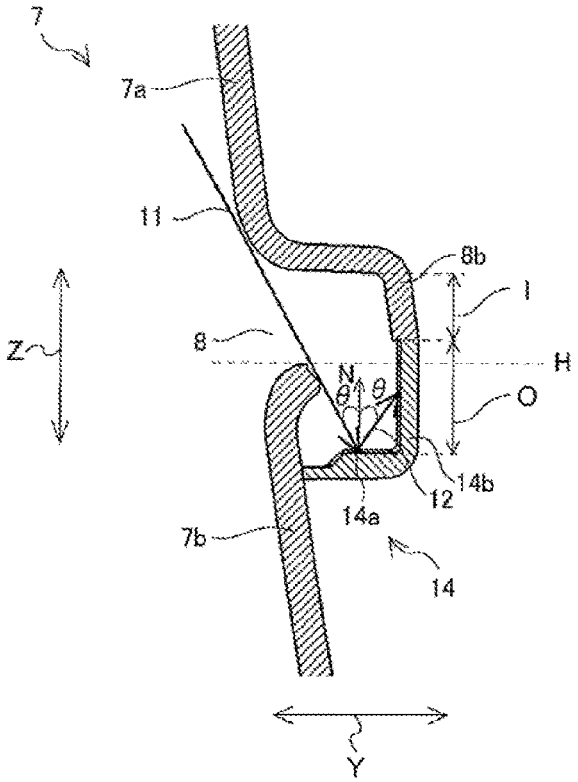
FIG. 10 is a sectional side view showing a traveling direction of light according to Embodiment 1 of the present invention.

FIG. 10, which is a sectional view taken along line B-B in FIG. 4, is a sectional side view showing a traveling direction of light according to Embodiment 1 of the present invention. Next, the traveling direction of light 11 entering the suction port 8 will be described. As shown in FIG. 10, when lighting is provided on a ceiling or other location above the indoor unit 1, the light 11 emitted from the lighting may enter the suction port 8 of the indoor unit 1. Part of the light 11 entering each of the connecting portions 14 of the suction port 8 is reflected off the bottom wall 14*a* and onto the inner wall 14*b*. In so doing, an incident angle 0 and reflection angle θ relative to a normal N extending perpendicularly from a surface of the bottom wall 14*a* are equal.

Of the light 11 reflected off the bottom wall 14*a*, light 11 (a solid arrow in FIG. 10) traveling along a line connecting the lower end of the upper panel 7*a* and the upper edge of the lower panel 7*b* is reflected onto the inner wall 14*b* at the highest position of the inner wall 14*b*. The light 11 is reflected off the bottom wall 14*a*, being the reflected light 12 reflected onto a position below a horizontal line H passing through the upper edge of the lower panel 7*b*. This makes it difficult for the people located in the room to see the reflected light 12 being reflected onto the inner wall 14*b*. In this way, Embodiment 1 can inhibit the part on which the connecting portion 14 is provided from brightening.

Note that the indoor unit 1 is generally provided near the ceiling in a room. Consequently, the people located in the room often look up to see the indoor unit 1. Therefore, even if the reflected light 12 falls slightly above the horizontal line H, the reflected light 12 is difficult to see. Here, of the inner wall 14*b* and upper inner wall 8*b*, an area where the reflected light 12 is difficult to see will be referred to as a non-visual area O and an area where the reflected light 12 is easy to see will be referred to as a visual area I. In the present embodiment, the bottom wall 14*a* is provided such that the position on the inner wall 14*b* onto which the reflected light 12 is reflected is below the horizontal line H passing through the upper edge of the lower panel 7*b*, but the position at which the reflected light 12 is reflected onto the inner wall 14*b* may be located slightly above the horizontal line H. That is, it is sufficient that the bottom wall 14*a* is provided such that the reflected light 12 will be reflected onto the non-visual area O.

Figure 11:
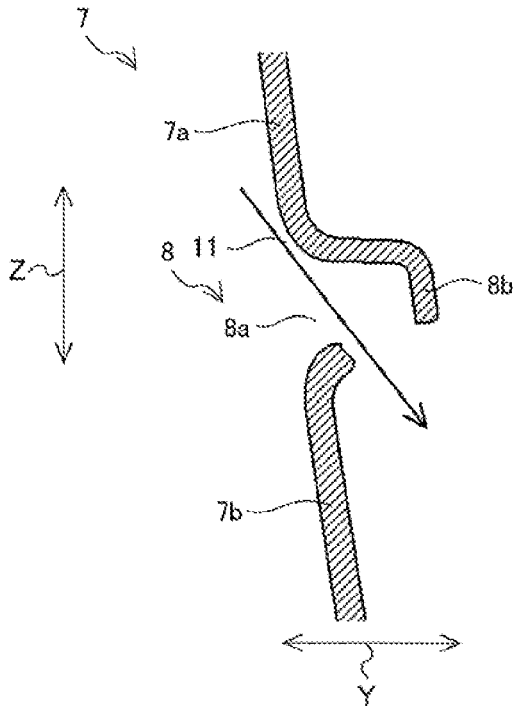
FIG. 11 is a sectional side view showing the traveling direction of light according to Embodiment 1 of the present invention.

FIG. 11, which is a sectional view taken along line C-C in FIG. 4, is a sectional side view showing the traveling direction of light according to Embodiment 1 of the present invention. As shown in FIG. 11, when the light 11 emitted from the lighting enters the suction slit 8*a* of the suction port 8, the light 11 passes through the suction slit 8*a* and then enters directly into the inside of the indoor unit 1. Consequently, the part in which the suction slit 8*a* is formed looks dark to the people located in the room.

As shown in FIGS. 10 and 11, both that part of the suction port 8 on which the connecting portions 14 are provided, and that part of the suction port 8 in which the suction slit 8*a* is formed look dark to the people located in the room. Consequently, light and dark fringes do not appear in the suction port 8.

According to the present embodiment, since the bottom wall 14*a* of each connecting portion 14 is located below the upper edge of the lower panel 7*b* of the front design panel 7, when light is reflected off the bottom wall 14*a*, the reflected light is reflected onto a low position of the inner wall 14*b*. This makes it possible to inhibit the part on which the connecting portions 14 are provided from brightening. In this way, light and dark fringes are less liable to appear in the suction port 8 of the front design panel 7, and thus the design of the indoor unit 1 is not spoiled. Also, because the size of the connecting portions 14 can be changed without causing light and dark fringes, it is possible to reinforce the strength of the front design panel 7 without reducing the size of the suction slit 8*a* and improve the strength. Thus, the present embodiment can ensure strength without spoiling the design of the front design panel 7 and reduce costs.

Embodiment 2

Figure 12:
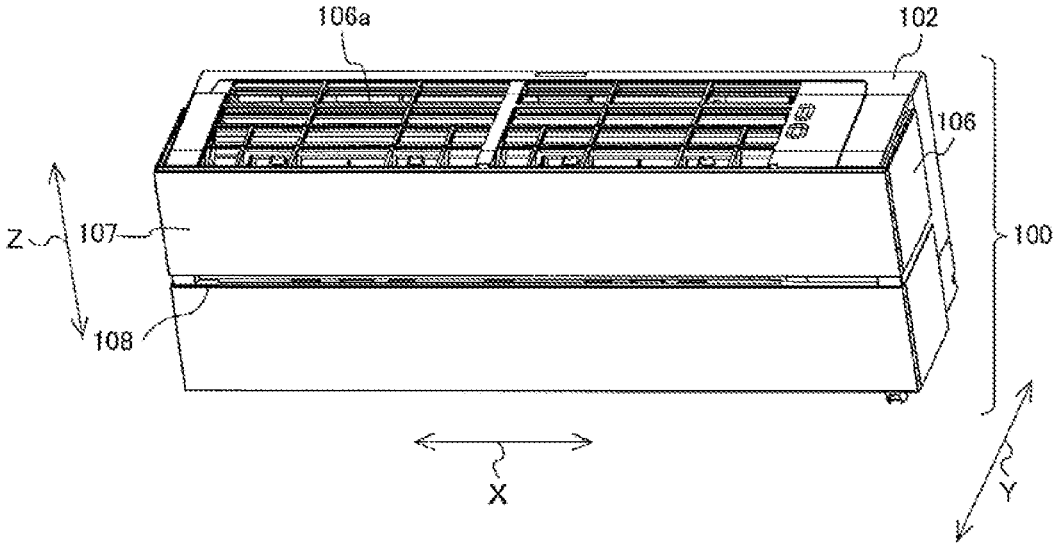
FIG. 12 is a perspective view showing an indoor unit 100 of an air-conditioning apparatus according to Embodiment 2 of the present invention.
Figure 13:
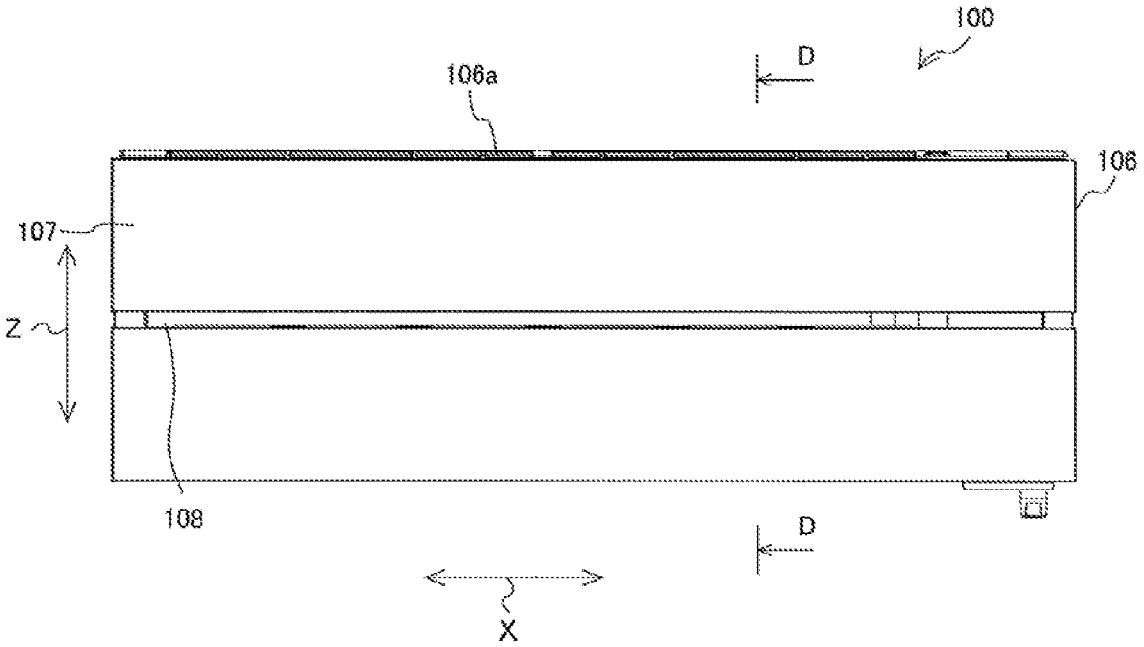
FIG. 13 is a front view showing the indoor unit 100 of the air-conditioning apparatus according to Embodiment 2 of the present invention.

FIG. 12 is a perspective view showing an indoor unit 100 of an air-conditioning apparatus according to Embodiment 2 of the present invention and FIG. 13 is a front view showing the indoor unit 100 of the air-conditioning apparatus according to Embodiment 2 of the present invention. Embodiment 2 differs from Embodiment 1 in the shape of the front design panel 107. In Embodiment 2, the same components as those of Embodiment 1 are denoted by the same reference numerals as the corresponding components in Embodiment 1 and description thereof will be omitted. Then, description will be given by focusing on differences from Embodiment 1.

As shown in FIGS. 12 and 13, the indoor unit 100 of the air-conditioning apparatus includes a rear case 102, a side design panel 106, and a front design panel 107. The rear case 102 is a flat-plate member attached to a wall or other structure in a room making up an air-conditioned space. The side design panel 106 is a box-shaped member attached to edges of the rear case 102, extending forward from the rear case 102. An upper suction port 106*a* through which air is sucked is formed in that part of the side design panel 106 that makes up the top of the indoor unit 100.

The front design panel 107 is a flat-plate member attached to edges of the side design panel 106. A suction port 108 through which air is sucked is formed in the front design panel 107. Consequently, an amount of sucked indoor air is increased, improving heat exchange performance of a heat exchanger 103 and an accent is given to the design of the indoor unit 100. Note that the front design panel 107 is rotatably mounted on shafts provided on opposite sides in upper part of the side design panel 106, and consequently configured to be attached/detached and closed/opened freely relative to the side design panel 106. By opening the front design panel 107, installation, cleaning, inspection, and other operations can be carried out easily.

Figure 14:
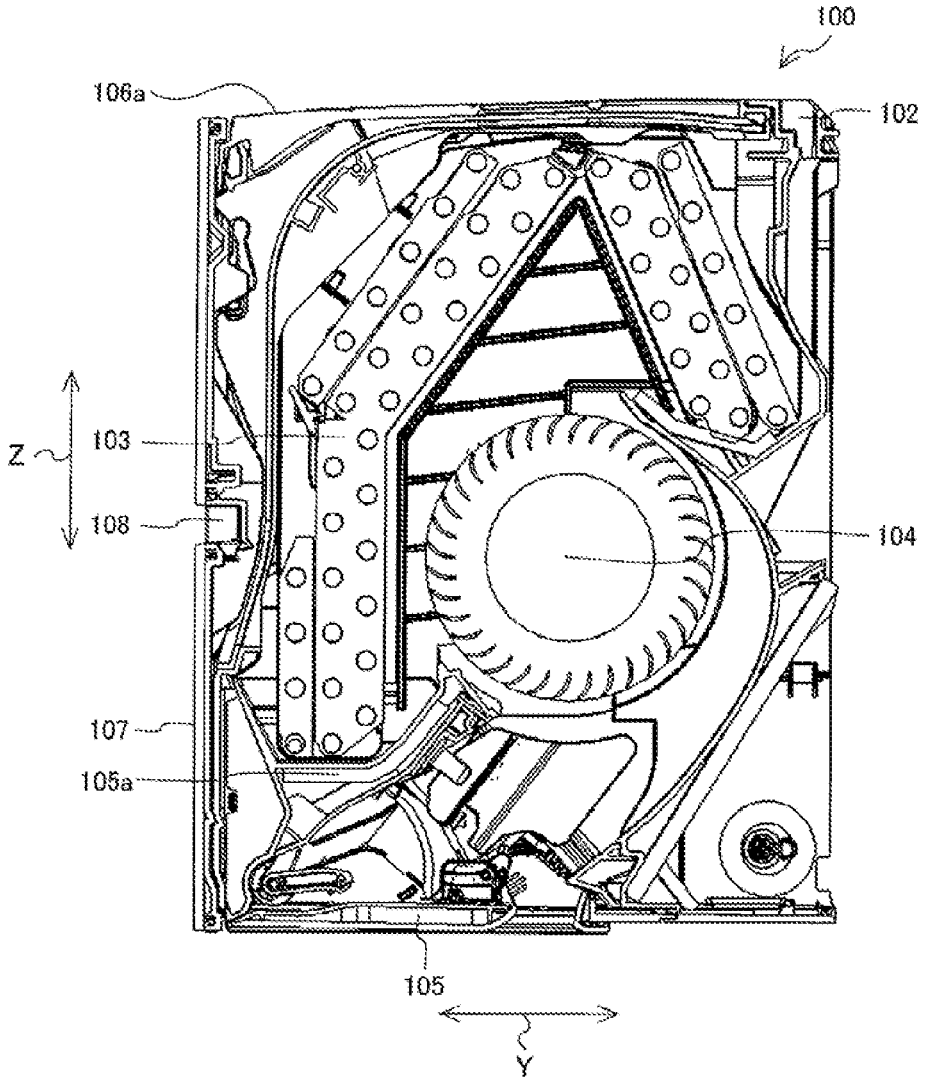
FIG. 14 is a sectional side view showing the indoor unit 100 of the air-conditioning apparatus according to Embodiment 2 of the present invention.

FIG. 14, which is a sectional view taken along line D-D in FIG. 13, is a sectional side view showing the indoor unit 100 of the air-conditioning apparatus according to Embodiment 2 of the present invention. As shown in FIG. 14, the indoor unit 100 contains the heat exchanger 103, a blower fan 104, a drain pan 105*a*, and an electrical component box (not shown). The heat exchanger 103 is a device adapted to exchange heat between indoor air and refrigerant. The blower fan 104 is a device adapted to send air sucked through the upper suction port 106*a* and suction port 108 to the heat exchanger 103. The drain pan 105*a* is a member adapted to catch dew condensation water attaching to the heat exchanger 103.

An air outlet 105 adapted to blow out the air heat-exchanged by the heat exchanger 103 into the room is formed below the drain pan 105*a*. The electrical component box contains control equipment adapted to control the blower fan 104 and other devices. The air sucked by the blower fan 104 through the upper suction port 106*a* and suction port 108 is heated or cooled by being heat-exchanged with refrigerant by the heat exchanger 103 and blown out into the room through the air outlet 105. Consequently, the room is heated or cooled.

Figure 15:
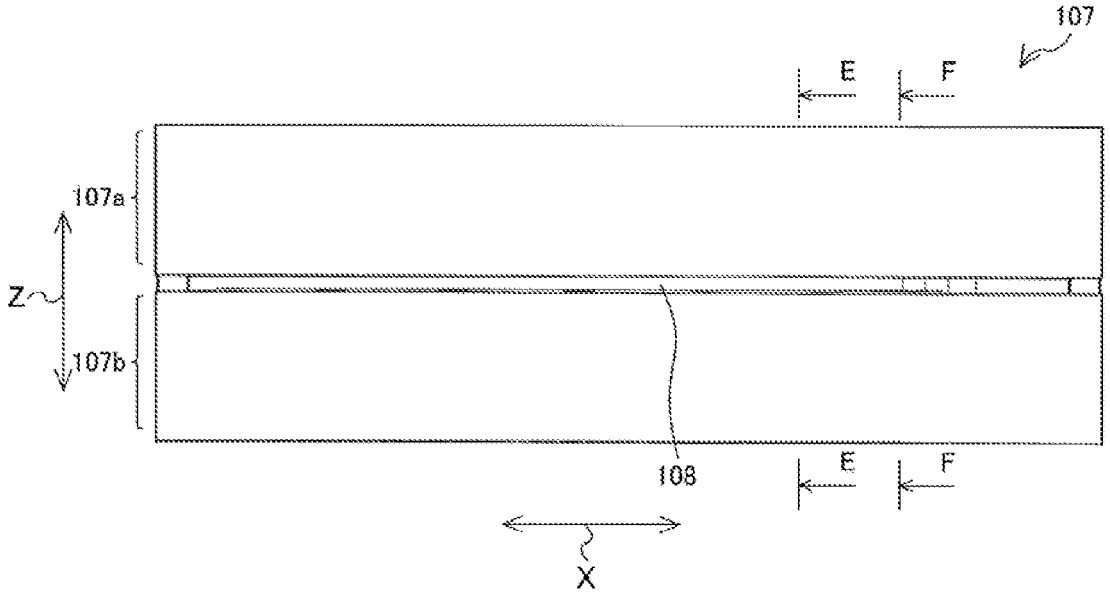
FIG. 15 is front view showing a front design panel 107 according to Embodiment 2 of the present invention.

FIG. 15 is front view showing a front design panel 107 according to Embodiment 2 of the present invention. As shown in FIG. 15, a recess is formed in the front design panel 107 as the suction port 108 through which air is sucked, the recess being depressed rearward from a front face and extending in a width direction.

Of the front design panel 107, part extending in the width direction below the recess is referred to as a lower panel 107*b* and part extending in the width direction above the recess is referred to as an upper panel 107*a*. Note that the lower panel 107*b* and upper panel 107*a* are connected with each on opposite sides of the front design panel 107.

Figure 16:
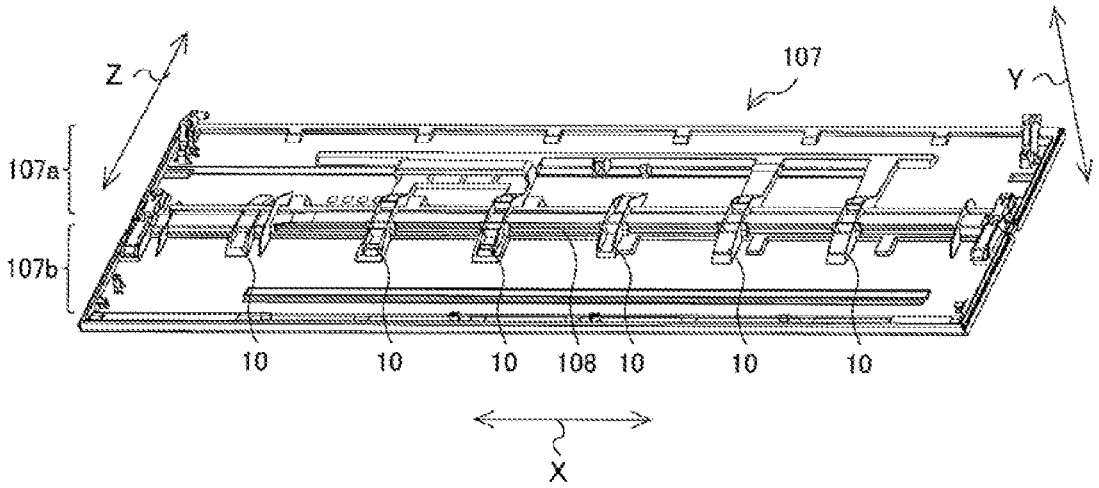
FIG. 16 is a rear perspective view showing the front design panel 107 according to Embodiment 2 of the present invention.

FIG. 16 is a rear perspective view showing the front design panel 107 according to Embodiment 2 of the present invention. As shown in FIG. 16, the upper panel 107*a* and lower panel 107*b* are not only connected with each other on opposite sides of the front design panel 107 but also connected in central part of the front design panel 107 by plural connecting portions 10. As the suction port 108 is formed, the front design panel 107 is divided into upper and lower sections, reducing the strength, which might cause cracks, deformation, damage, or other similar conditions to occur starting from opposite ends of the suction port 108. The lower panel 107*b* and upper panel 107*a* of the front design panel 107 are connected with each other by plural connecting portions 10, making it possible to curb reduction in the strength. Note that the connecting portions 10 are formed integrally with the upper panel 107*a* and lower panel 107*b*.

Figure 17:
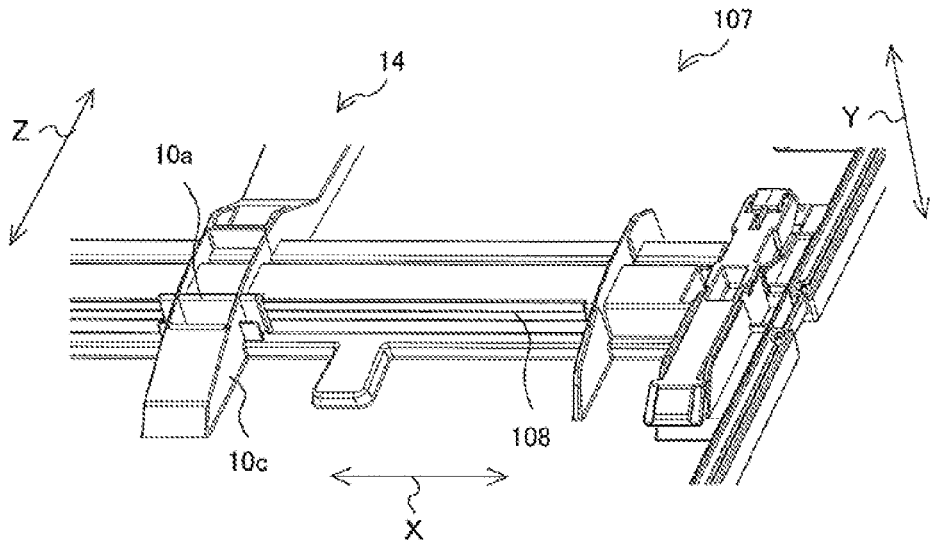
FIG. 17 is a rear perspective view showing a connecting portion 10 of the front design panel 107 according to Embodiment 2 of the present invention.

FIG. 17 is a rear perspective view showing the connecting portion 10 of the front design panel 107 according to Embodiment 2 of the present invention. As shown in FIG. 17, the connecting portion 10 includes a bottom wall 10*a* and bridging portions 10*c*. The bridging portions 14*c* are members provided at opposite ends of the bottom wall 10*a*, extending behind the bottom wall 10*a*, to connect the lower panel 107*b* and upper panel 107*a* in conjunction with the bottom wall 10*a*.

Figure 18:
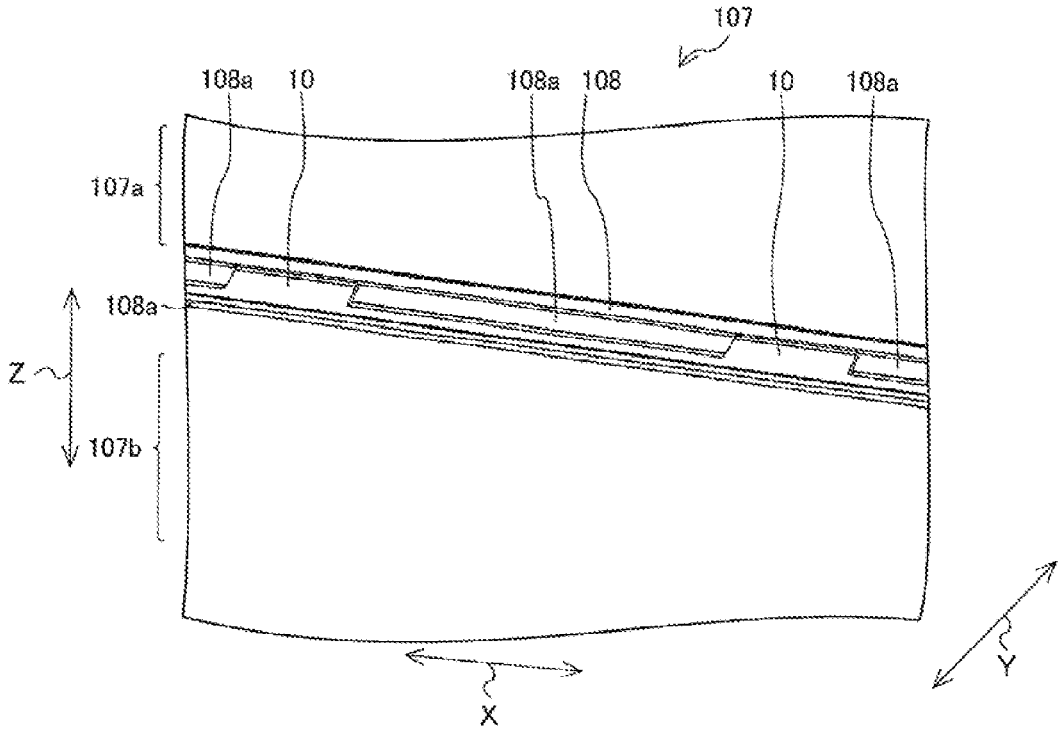
FIG. 18 is a front perspective view showing the connecting portions 10 of the front design panel 107 according to Embodiment 2 of the present invention.

FIG. 18 is a front perspective view showing the connecting portions 10 of the front design panel 107 according to Embodiment 2 of the present invention. As shown in FIG. 18, the connecting portions 10 are provided on part of the suction port 108 in the front design panel 107. Those parts of the suction port 108 on which no connecting portion 10 is provided are suction slits 108*a* adapted to actually suck in air.

Figure 19:
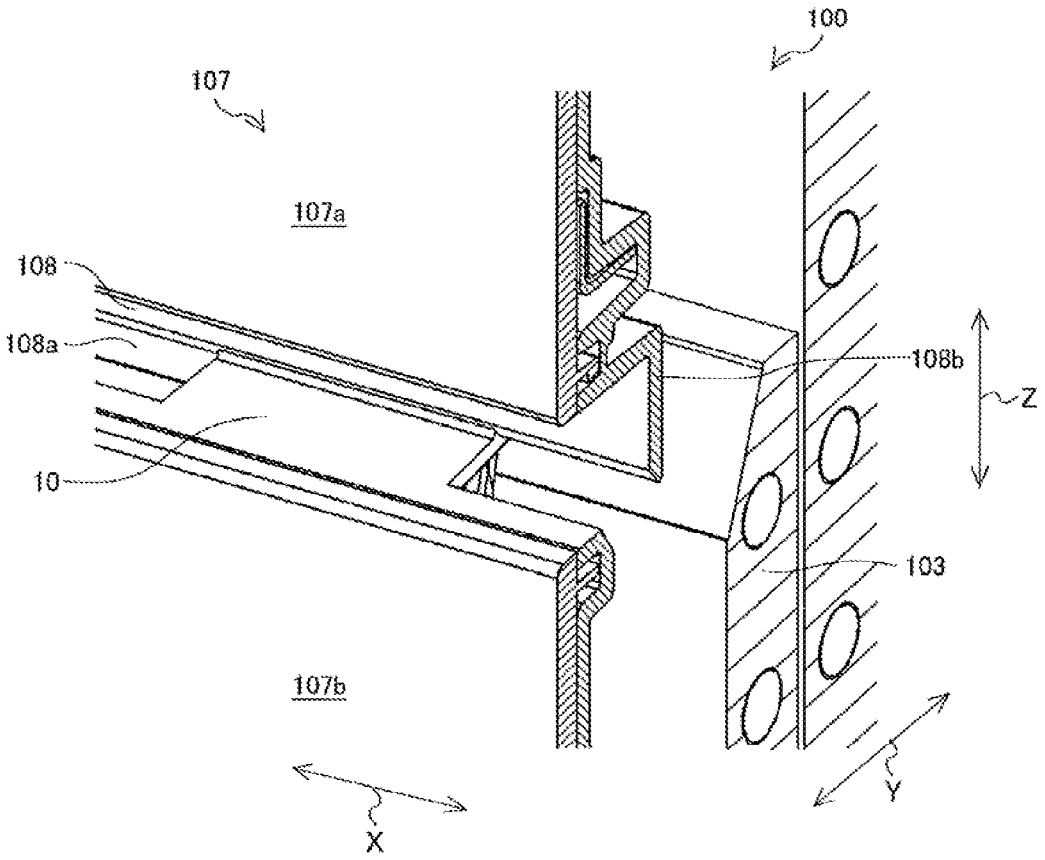
FIG. 19 is a perspective sectional view showing the indoor unit 100 of the air-conditioning apparatus according to Embodiment 2 of the present invention.

FIG. 19, which is a sectional view taken along line A-A in FIG. 13, is a perspective sectional view showing the indoor unit 100 of the air-conditioning apparatus according to Embodiment 2 of the present invention. As shown in FIG. 19, a lower end of the upper panel 107*a* is bent rearward, and then bent downward to become an upper inner wall 108*b*. The connecting portion 10 includes a bottom wall 10*a* connecting an upper edge of the lower panel 107*b* and a lower end of the inner wall 14*b*. The bottom wall 10*a* is located at the same height as the upper edge of the lower panel 107*b*.

Figure 20:
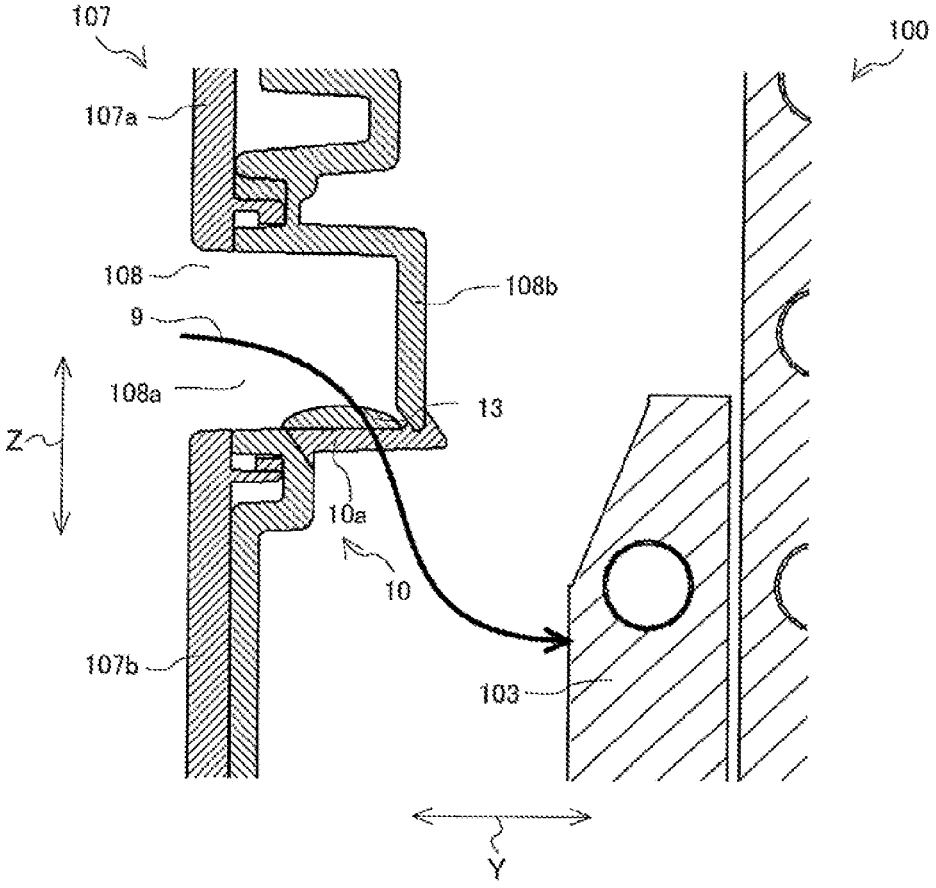
FIG. 20 is a sectional side view showing the indoor unit 100 of the air-conditioning apparatus according to Embodiment 2 of the present invention.

FIG. 20, which is a sectional view taken along line A-A in FIG. 13, is a sectional side view showing the indoor unit 100 of the air-conditioning apparatus according to Embodiment 2 of the present invention. Next, a flow of air 9 sucked through the suction port 108 will be described. As shown in FIG. 20, the air 9 sucked through the suction port 108 passes through the suction slits 108*a*, i.e., those parts of the suction port 108 on which no connecting portion 10 is provided, and reaches the heat exchanger 103. Note that an additional component 13, which will be described later, is mounted on the bottom wall 10*a*.

Figure 21:
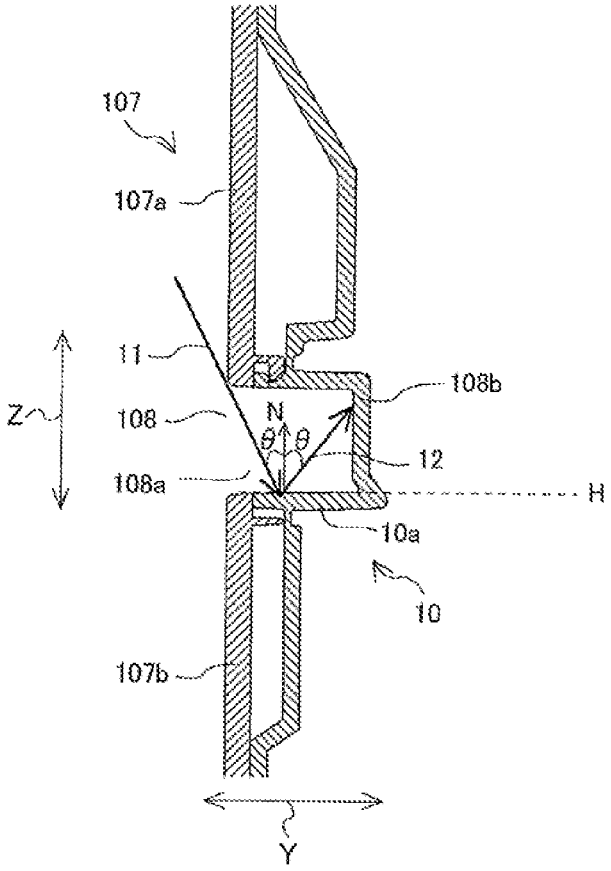
FIG. 21 is a sectional side view showing a traveling direction of light according to a comparative example.

FIG. 21, which is a sectional view taken along line E-E in FIG. 15, is a sectional side view showing a traveling direction of light according to a comparative example. Next, a traveling direction of light 11 entering the suction port 108 will be described. Note that FIG. 21 shows a comparative example in which the additional component 13 has been removed from the connecting portion 10 of the indoor unit 100 of the present embodiment shown in FIG. 20. In FIG. 21, the traveling direction of light 11 entering the connecting portion 10 will be described. As shown in FIG. 21, part of the light 11 entering the connecting portion 10 of the suction port 108 is reflected off the bottom wall 10*a* onto the upper inner wall 108*b*. Of the light 11 reflected off the bottom wall 10*a*, light 11 (a solid arrow in FIG. 21) traveling along a line connecting the lower end of the upper panel 107*a* and the upper edge of the lower panel 107*b* is reflected onto the upper inner wall 108*b* at the highest position. After the light 11 is reflected off the bottom wall 10*a*, a position at which the reflected light 12 is reflected onto the inner wall 14*b* is located above the horizontal line H because the bottom wall 10*a* is located at the same height as the horizontal line H passing through the upper edge of the lower panel 107*b*. Consequently, the reflected light 12 being reflected onto the inner wall 14*b* is visible to the people located in the room. Thus, in the suction port 108, the part on which the connecting portions 10 are provided appears bright.

Figure 22:
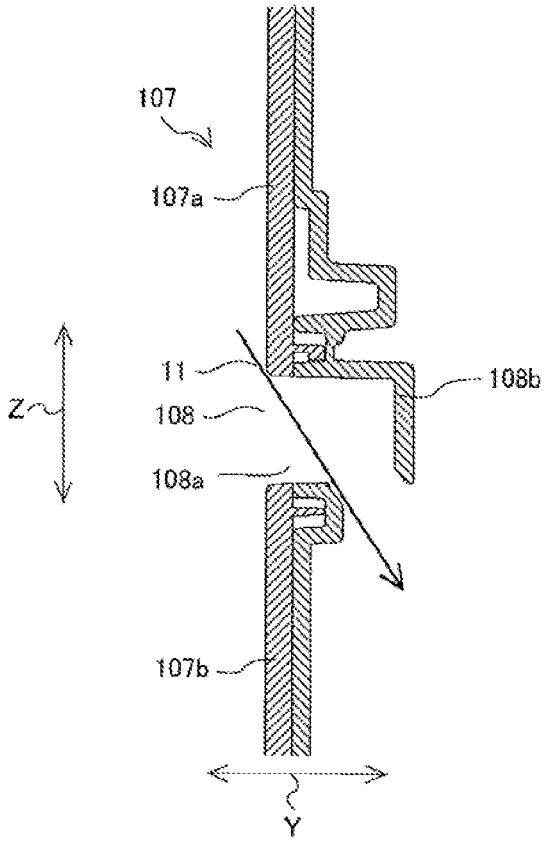
FIG. 22 is a sectional side view showing a traveling direction of light according to Embodiment 2 of the present invention.

FIG. 22, which is a sectional view taken along line F-F in FIG. 15, is a sectional side view showing a traveling direction of light according to Embodiment 2 of the present invention. In FIG. 22, the traveling direction of light 11 entering the suction slit 108*a* not provided with any connecting portion 10 will be described. As shown in FIG. 22, when the light 11 emitted from the lighting enters the suction slit 108*a* of the suction port 108, the light 11 passes through the suction slit 108*a* and then enters directly into the inside of the indoor unit 100. Consequently, the part in which the suction slit 108*a* is formed looks dark to the people located in the room.

As shown in FIG. 21, when the additional component 13 has been removed from the connecting portion 10, that part of the suction port 108 on which the connecting portion 10 is provided looks bright to the people located in the room while the part in which the suction slit 108*a* is formed looks dark to the people located in the room. Consequently, light and dark fringes appear in the suction port 108, which might degrade the design of the front design panel 107.

Figure 23:
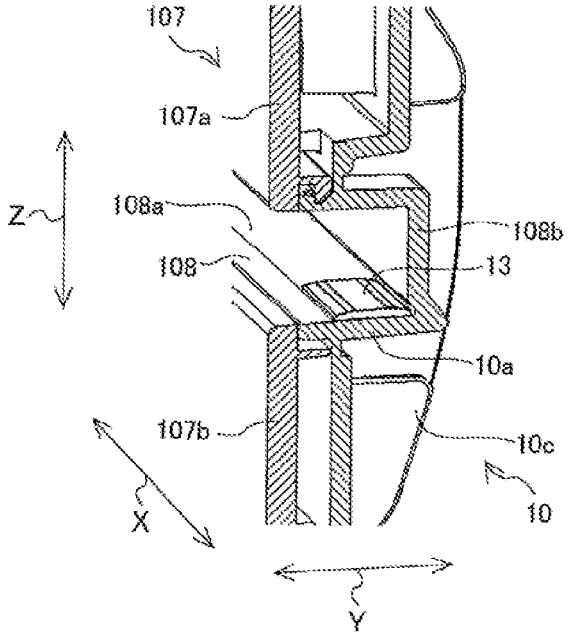
FIG. 23 is a sectional side view showing the connecting portion 10 of the front design panel 107 according to Embodiment 2 of the present invention.

FIG. 23 is a sectional side view showing the connecting portion 10 of the front design panel 107 according to Embodiment 2 of the present invention. Next, the additional component 13 shown in FIG. 20 will be described. The additional component 13 is a nonreflexive member adapted to inhibit occurrence of light and dark fringes. As shown in FIG. 23, by installing the additional component 13 on the connecting portion 10, reflection of light on the connecting portion 10 is inhibited.

Figure 24:
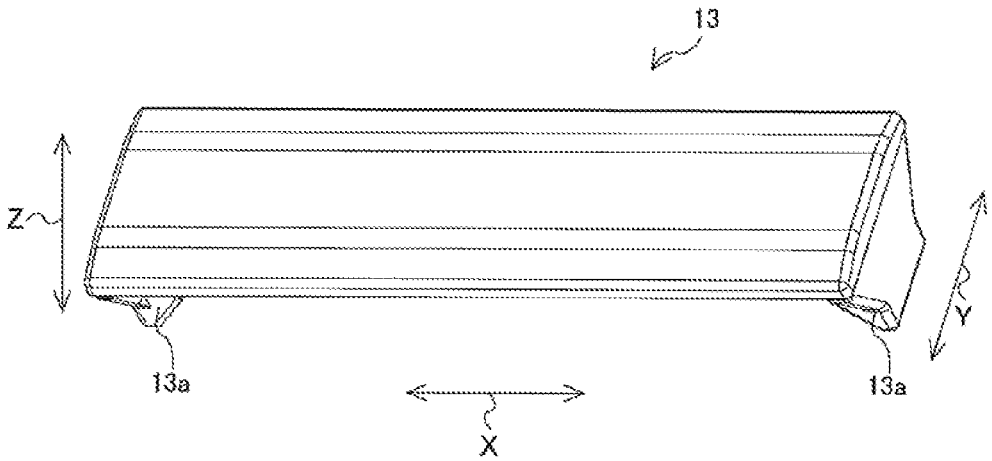
FIG. 24 is a perspective view showing an additional component 13 of the front design panel 107 according to Embodiment 2 of the present invention.

FIG. 24 is a perspective view showing the additional component 13 of the front design panel 107 according to Embodiment 2 of the present invention. As shown in FIG. 24, the additional component 13 is a member elongated in the width direction and claws 13*a* are provided in opposite end portions. As the claws 13*a* are hooked to both ends of the connecting portion 10, the additional component 13 is attached to the connecting portion 10. Consequently, since reflection of light on the connecting portion 10 is inhibited, both that part of the suction port 108 on which the connecting portion 10 is provided and that part of the suction port 108 in which the suction slit 108*a* is formed look dark to the people located in the room. Thus, light and dark fringes do not appear in the suction port 8.

According to the present embodiment, by simply installing the additional component 13 at some extra cost, light and dark fringes can be made less liable to appear in the suction port 108 of the front design panel 107. As a result, the design of the indoor unit 100 is not spoiled. Note that whereas the additional component 13 is provided on the connecting portion 10 in the present embodiment, reflection of light may be inhibited, by increasing surface roughness of the connecting portion 10.

Embodiment 3

Figure 25:
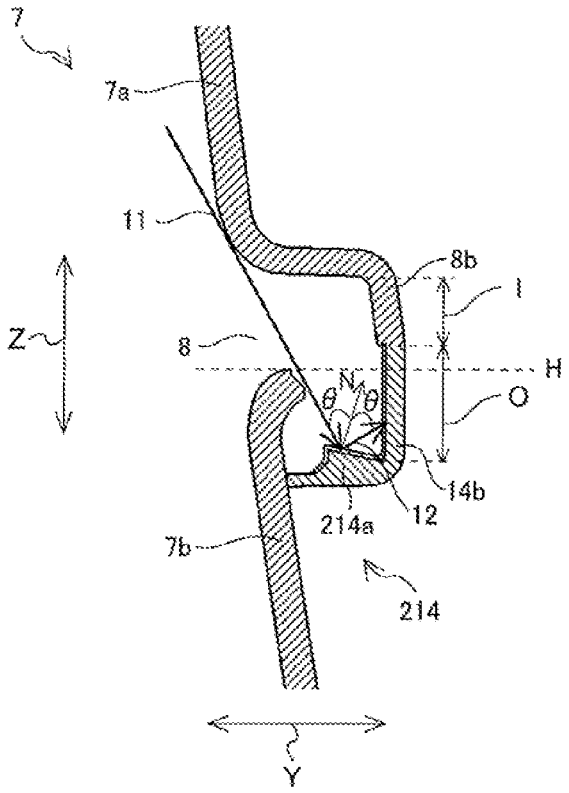
FIG. 25 is a sectional side view showing a connecting portion 214 of a front design panel 7 according to Embodiment 3 of the present invention.

FIG. 25 is a sectional side view showing a connecting portion 214 of a front design panel 7 according to Embodiment 3 of the present invention. Embodiment 3 differs from Embodiment 1 in the shape of the connecting portion 214 of the front design panel 7 on the indoor unit 200 of the air-conditioning apparatus. In Embodiment 3, the same components as those of Embodiment 1 are denoted by the same reference numerals as the corresponding components in Embodiment 1 and description thereof will be omitted. Then, description will be given by focusing on differences from Embodiment 1.

As shown in FIG. 25, a bottom wall 214*a* of the connecting portion 214 is inclined downward from the lower panel 7*b*. In so doing, a normal N extending perpendicularly from a surface of the bottom wall 214*a* is inclined toward an inner wall 14*b*. Therefore, even if the light 11 entering the suction port 8 is reflected off the bottom wall 214*a*, the reflected light 12 is reflected onto the inner wall 14*b* at a lower position. Consequently, it is more difficult for the people located in the room to see the reflected light 12 being reflected onto the inner wall 14*b*. Thus, light and dark fringes can be further inhibited from appearing in the suction port 8.

REFERENCE SIGNS LIST

1 indoor unit 2 rear case 3 heat exchanger 4 blower fan 5 air outlet 5*a* drain pan 6 side design panel 6*a* upper suction port 7 front design panel 7*a* upper panel 7*b* lower panel 8 suction port 8*a* suction slit 8*b* upper inner wall 9 air 10 connecting portion 10*a* bottom wall 10*c* bridging portion 11 light 12 reflected light 13 additional component 13*a* claw 14 connecting portion 14*a* bottom wall 14*b* inner wall 14*c* bridging portion 100 indoor unit 102 rear case 103 heat exchanger 104 blower fan 105 air outlet 105*a* drain pan 106 side design panel 106*a* upper suction port 107 front design panel 107*a* upper panel 107*b* lower panel 108 suction port 108*a* suction slit 108*b* upper inner wall 200 indoor unit 214 connecting portion 214*a* bottom wall

The invention claimed is:

1. An indoor unit of an air-conditioning apparatus, the indoor unit comprising a front design panel, adapted to cover a heat exchanger, in which a recess is formed as a suction port through which air is sucked, the recess being depressed rearward from a front face and extending in a width direction, the front design panel including a lower panel extending in the width direction below the recess, an upper panel extending in the width direction above the recess, and a connecting portion connecting a back side of the lower panel and a back side of the upper panel, the connecting portion including a bottom wall extending rearward from the lower panel, and an inner wall extending upward from the bottom wall and connecting to the upper panel, the bottom wall being located below an upper edge of the lower panel, wherein light traveling along a line connecting a lower end of the upper panel and the upper edge of the lower panel is reflected off the bottom wall onto a position on the inner wall, the position being below a horizontal line passing through the upper edge of the lower panel.

2. The indoor unit of an air-conditioning apparatus of claim 1, wherein the bottom wall is inclined downward in a direction behind the lower panel.

3. The indoor unit of an air-conditioning apparatus of claim 1, wherein the connecting portion further includes bridging portions provided at opposite ends of the bottom wall and the inner wall, extending behind the bottom wall and the inner wall and connecting the lower panel and the upper panel with each other.

* * * * *